US005085583A

United States Patent [19]

Amos et al.

[11] Patent Number: 5,085,583

[45] Date of Patent: Feb. 4, 1992

[54] PORTABLE LOADMAKE/LOADBREAK SWITCH AND LIVELINE EYEBOLT TERMINAL CLAMP

[76] Inventors: Warren E. Amos, 1528 Hybla Rd., Richmond, Va. 23236; Michael Chupka, 3601 Stoney Ridge Rd., Midlothian, Va. 23112

[21] Appl. No.: 698,086

[22] Filed: May 10, 1991

[51] Int. Cl.[5] ..... H01R 13/00

[52] U.S. Cl. ..... 439/479; 439/803

[58] Field of Search ..... 439/181, 198, 476, 477, 439/478, 479, 480, 507, 796-798, 789-791, 801, 803, 807, 811, 812, 813, 921; 81/53.1

[56] References Cited

U.S. PATENT DOCUMENTS

| | | | |
|---|---|---|---|
| 2,107,061 | 2/1938 | Pittman et al. | 439/887 X |
| 2,448,402 | 8/1948 | Thompson | 439/817 X |
| 2,506,010 | 5/1950 | Birkenmaier | 439/803 |
| 2,966,817 | 1/1961 | Wengen | 439/791 X |
| 3,036,286 | 5/1962 | Gorc et al. | 439/803 X |
| 3,259,875 | 7/1966 | Ewers | 439/198 |
| 3,516,050 | 6/1970 | Mixon, Jr. et al. | 439/479 |
| 4,097,108 | 6/1978 | Prodel | 439/803 X |
| 4,865,559 | 9/1989 | Clabburn | 439/724 X |

*Primary Examiner*—Neil Abrams
*Assistant Examiner*—Khiem Nguyen
*Attorney, Agent, or Firm*—Cushman, Darby & Cushman

[57] ABSTRACT

This invention involves a portable loadmake/loadbreak switch assembly or system which can be used to make or break high amperage power circuits. This switch is first connected in series with the circuit. When the current is running through the switch, the switch can be opened to break the current in a controlled manner. This switch includes two leads, each of which is provided with a special two part clamp. The first parts of the clamps of both leads are first clamped onto two eyebolt connectors along the circuit. This clamping is accomplished by rotating a portion of each first part in a clockwise direction. A second clamp part is then attached to the first part of the clamp on the loadside lead. Once attached, this second part allows the eyebolt to be loosened by rotating the entire clamp in a counterclockwise direction. Due to the second part of this clamp, the first part of this clamp's grip on the eyebolt is not loosened. Because the removed eyebolt is connected to the power cable, removing the eyebolt from its connection point on the circuit with the clamp results in the clamp holding both the eyebolt and the removed power cable. With the first lead of the switch is still connected to a eyebolt in the circuit, and with the second lead connected to the removed power cable, the switch is connected in series with the circuit. The switch can then break the circuit in a controlled manner.

17 Claims, 4 Drawing Sheets

70
74
72

25
26
27
29
24
28
33
68
37
23a
27
70
54
40

23a
54
35
39
28
32
34

PORTABLE LOADMAKE/LOADBREAK SWITCH AND LIVELINE EYEBOLT TERMINAL CLAMP

BACKGROUND OF THE INVENTION

1. Field of the Invention

This invention relates to a portable loadmake/loadbreak switch and special connecting and disconnecting clamps which are used with the switch. The switch and the clamps can be used together to connect or disconnect two ends of a power line without arcing.

2. Background of the Related Art

Devices for tapping onto high power electrical cables with clamps have long been known. To make a connection to a power line, a clamp, which resembles the common C-clamp, is clamped directly onto the body of the line. A cable is permanently connected to the conductive body of the clamp so that the power line can be tapped. Examples of such clamps are set forth in U.S. Pat. No. 2,107,061 issued to R. Pittman et al., U.S. Pat. No. 2,514,474 issued to J. Cook, U.S. Pat. No. 2,506,010 issued to T. Birkenmaier, U.S. Pat. No. 2,448,402 issued to B. Thompson, U.S. Pat. No. 3,036,286 issued to F. Gorc et al. and U.S. Pat. No. 4,097,108 issued to Prodel.

Standard clamps have also been used in combination with other latching and hooking mechanisms. U.S. Pat. No. issued to T. Dunman, for example, discloses using a groove clamp used in combination with a C-clamp U.S Pat. No. 3,516,050 issued to J. Mixon, Jr. et al. discloses a method of using a standard clamp to crimp a second cable to a high power line. U.S. Pat. No. 3,259,875 issued to R. Ewers discloses a jumper device, each end of which is fitted with a standard clamp for attaching that end of the jumper to another line.

Multiple variations of gripping sticks are also known in the art. U.S. Pat. No. 2,316,428 issued to W. Heinrich, for example, discloses a clamp stick with a connecting member. The connecting member slides in and out in order to operate a hook at the end of the stick. U.S. Pat. No. 4,582,352 issued to Filter et al. discloses another stick tool. This tool provides a hook which is used to disconnect a cable from a transformer terminal by grabbing onto a pulling eye and then simply pulling the eye directly out from the terminal. U.S. Pat. No. 4,470,328 issued to Landis discloses another stick tool. This stick tool has a special collar which is adapted to lock onto the eyebolt of a standard C-clamp.

SUMMARY OF THE INVENTION

This invention involves a loadmake/loadbreak switch assembly or system. This system includes two leads, each of which is provided with a special livefront terminal clamp. This invention can be used by distribution personnel to energize and de-energize sections of a power line on a live front underground residential distribution system or in other instances when high power lines are to be handled, connected or disconnected. In such distribution systems, the primaries of a number of transformers may be daisy-chained together in series. An incoming "source" cable from a previous transformer primary is connected to the primary of the transformer of interest. An outgoing "loadside" cable leading to a subsequent transformer is also connected to the primary of the transformer of interest.

To connect the switch of this invention in series in this daisy chain, the terminal clamps of the two leads are used to connect the switch between the two eyebolt connectors which connect the "source" and "loadside" cables to the transformer primary. Due to the design of the clamps, one of the clamps can be operated to remove one of the cables from the transformer without disconnecting that cable from the switch. Because the other lead of the switch is still connected to the other eyebolt connector of the transformer, an electrical connection is maintained from the disconnected cable, through the switch, and to the eyebolt connection which is intact at the transformer primary. The switch can then be opened to break current flow in a controlled fashion within the switch system and specifically inside the switch without arching between the connectors.

After repair of the disconnected portion of the circuit, the switch can be connected between the disconnected portion of the cable and the transformer primary. By closing the switch, electrical flow can be started through the switch in a controlled fashion without arcing. The clamps of the switch can then be used to reconnect the disconnected cable to the transformer while maintaining current flow through the switch. After reconnection, the leads of the switch can then be removed from the transformer altogether.

BRIEF DESCRIPTION OF THE INVENTION

DETAILED DESCRIPTION OF THE PREFERRED EMBODIMENTS

Figure 1:
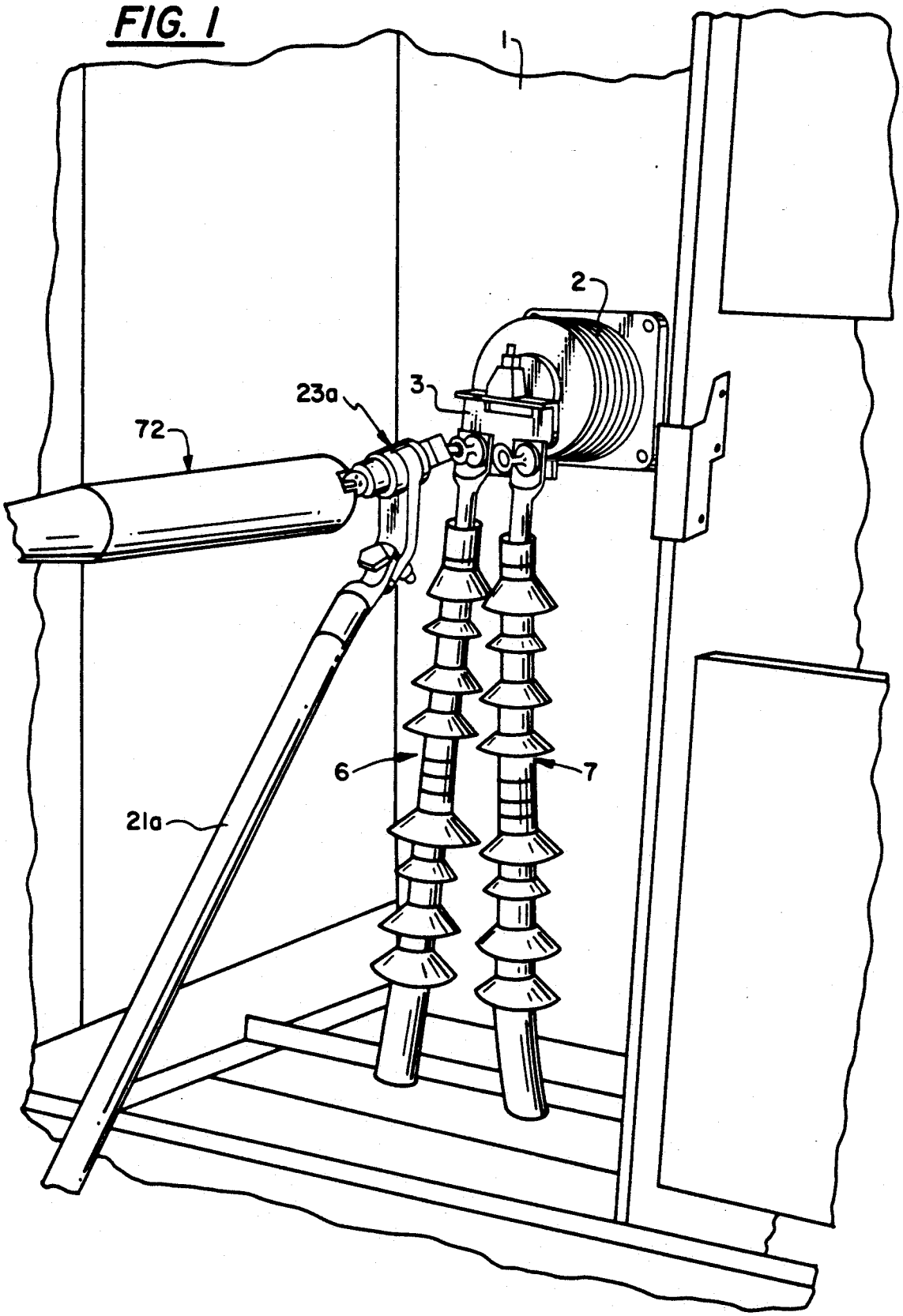
FIG. 1 is a view of a livefront padmount transformer having two eyebolt connections to a transformer bushing plate.

FIG. 1 depicts one possible type of circuit, the continuity of which can be broken or established with the present invention. The figure shows a transformer 1 with a livefront cable terminal 2 and a bushing plate 3.

Figure 2:
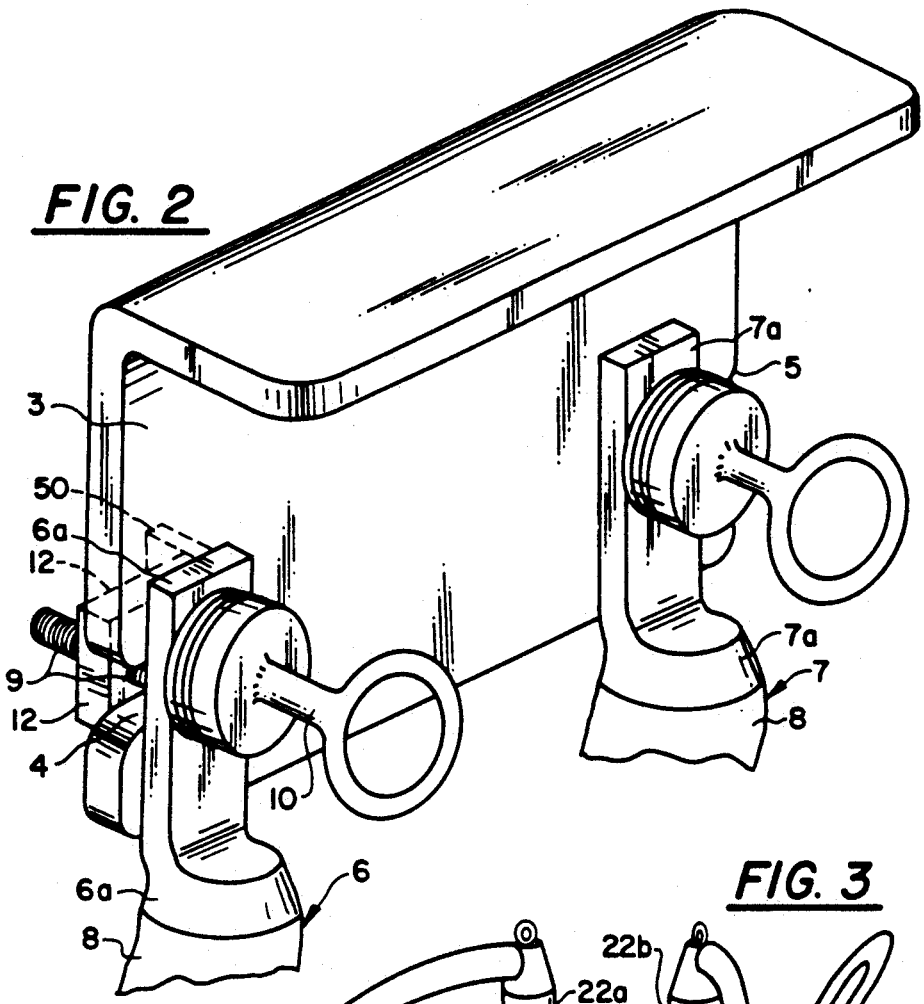
FIG. 2 is a close up view of two eyebolt connections to a transformer bushing plate.

FIG. 2 is a magnified view showing an angled view of bushing plate 3. This bushing plate has two slots 4 and 5. Two power cables 6 and 7, one "source" cable 6 coming from a previous transformer and one "load side" cable 7 leading to a subsequent transformer, are shown connected to the two respective slots 4 and 5 in bushing plate 3. Each of these cables is provided with an end connector member *6a*, *7a*, respectively, and an outer layer of line insulation 8. Each end connector has a hole through which a threaded shaft of an eyebolt passes. FIG. 2 shows such an arrangement where a threaded shaft 9 of an eyebolt 10 passes through a hole in the end connector *6a*. A nut 12, attached to threaded shaft 9, secures eyebolt 10 with its associated cable 6.

This eyebolt, nut and cable assembly can hold the cable 6, for example, to the bushing plate 3 when the nut on the eyebolt is tightened to clamp eyebolt 10 into a slot 4 of the bushing plate. The eyebolt, nut and cable assembly can also be removed from the bushing plate by loosening the eyebolt from the nut. The assembly can then be slipped out from the appropriate slot in the bushing. To loosen or to tighten, only the eyebolt need be rotated due to the presence of a raised rail extending outwardly from the rear surface of the plate. An exemplary rail is shown in dotted lines at 50 in FIG. 2. It is positioned so that nut 12 will abut one side when connector 6a is in place and this prevents nut 12 from rotating with the rotating eyebolt.

Figure 3:
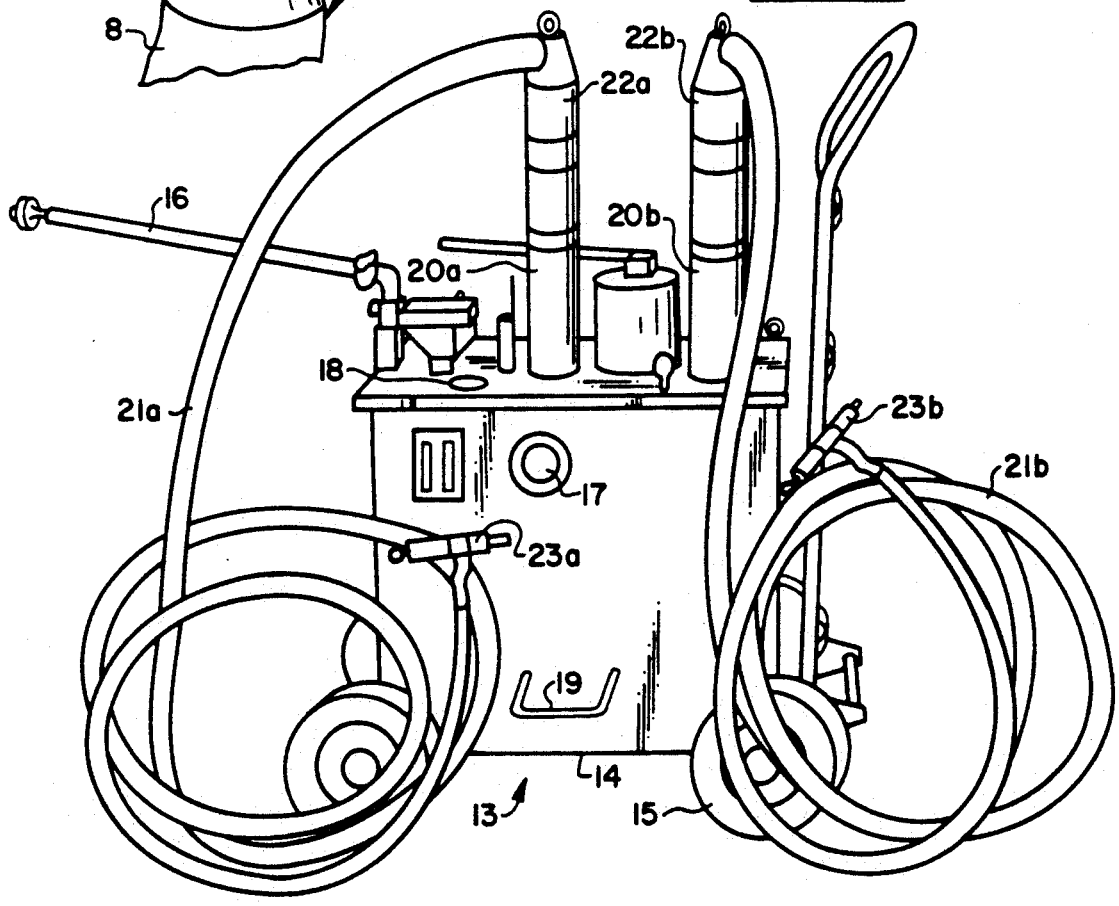
FIG. 3 shows the portable loadmake/loadbreak switch system of this invention.

FIG. 3 shows the portable loadmake/loadbreak switch system or assembly, generally indicated at 13. This portable loadmake/loadbreak switch system 13 includes a single phase, 38 KV, SF. gas insulated, 600 amp switch (not shown). The switch weighs 150 pounds and is mounted in a four wheel cart 14 with pneumatic tires 15 for easy rolling across soft soils and yards. The switch has a dry well fuse canister with a 40 amp ELX type current limiting fuse. A safety latch is provided for removing the fuse when the switch is closed. A removable operating handle 16 opens and closes the switch. A viewing port 17 is provided for visual indication of the open and closed contact position. The gauge 18 indicates $SF_6$ gas operating pressure. A ground attachment point 19 is provided to connect the switch to the underground residential distribution system ground. Bushing extenders 20a and 20b are utilized to connect the switch leads 200 amp elbows to the 600 amp switch line and load bushings.

Using currently available fuses (40 amp ELX), the maximum total transformer name plates KVA rating that can be picked up with the switch is:

| VOLTAGE PHASE TO GROUND | 2.4 KV | 7.2 KV | 7.6 KV | 13.2 KV | 19.9 KV |
|---|---|---|---|---|---|
| MAXIMUM LOAD | 90 KVA | 260 KVA | 275 KVA | 475 KVA | 720 KVA |

Also the fuse is the limiting factor on the load carrying capacity of the switch. The fuse can handle 50 amps. Therefore, the switch can be utilized to drop a load as long as the load current is 50 amps or less.

The system 13 also includes two braided shield wire leads, 21a and 21b, which are insulated for 35 KV. Two 200 amp elbows 22a and 22b are provided to connect one end of each of the leads to the bushing extenders 20a and 20b. Because the bushing extenders are a dead break connection, the elbows, 22a and 22b, are not to be removed when energized. Waferless 3M terminations are provided on the ends of the leads opposite the elbows. These terminations are used to connect the leads to special livefront terminal clamps 23a and 23b.

These clamps are used to connect the two leads 21a, 21b to the eyebolt connectors of the source and loadside cables. These clamps can then be used to remove or connect an eyebolt, nut and cable assembly from/to the bushing plate while maintaining the connection between the switch and the eyebolt of the cable. Each clamp consists of two parts: a part A and a part B.

Figure 4:
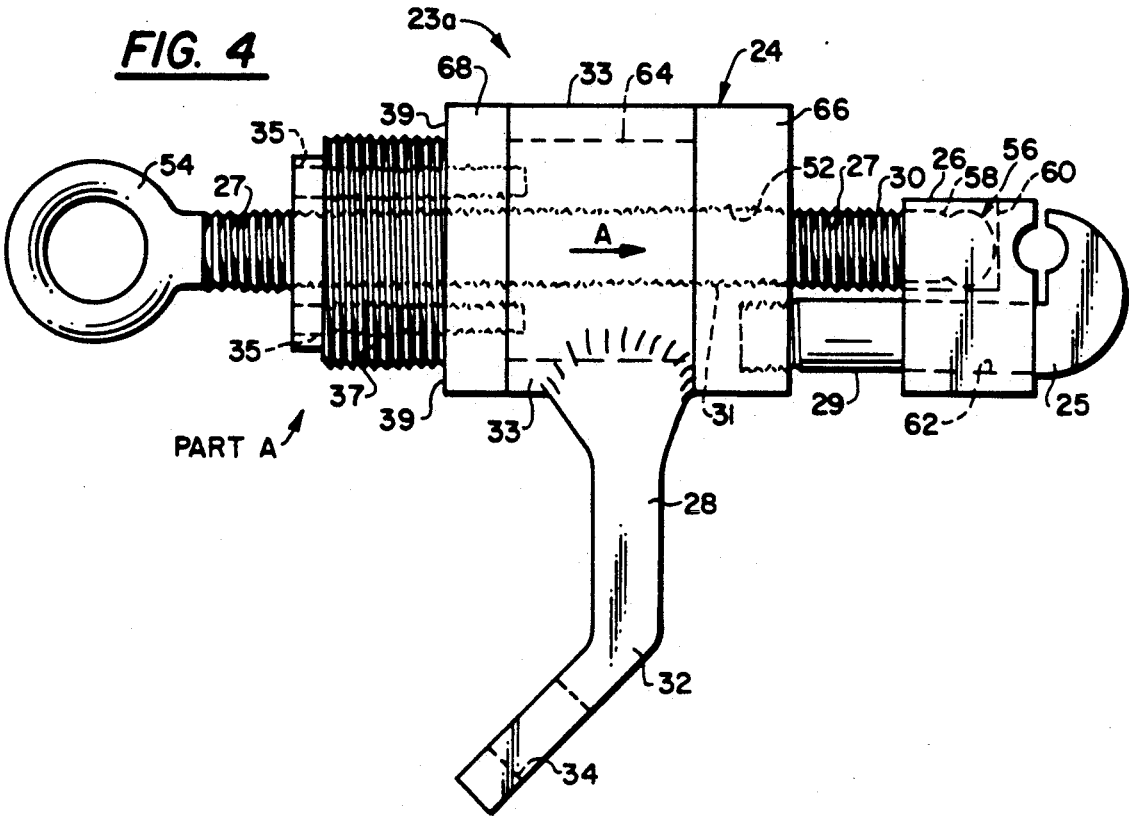
FIG. 4 is a side view of an embodiment of part A of the clamp of this invention which is adapted for eyebolt type connectors.

FIG. 4 shows part A of one exemplary embodiment of such a clamp which is adapted for use with Anderson eyebolt type connectors. Part A is used to connect the leads of the switch to the two eyebolts of a live front cable terminal. Part A of the clamp is comprised of a main body member 24 with a stationary jaw 25, a moveable clamping jaw 26 connected via a rotatable connection generally shown at 56 to a threaded shaft 27, the rotation of which moves the clamping means 27 toward and away from jaw 25. Threaded shaft 27 is engaged by a threaded bore 52 extending through body member 24. The opposite end of shaft 27 terminates in an eyebolt connection 54. The rotating connection 56 can be comprised of a spherical tip 58 on shaft 27 retained in a key way type slot 60. The moveable jaw 26 moves back and forth along axis A. A hole 62 in the moveable jaw slidably engages the shaft 29 of stationary jaw 25 then is secured in body member 24. When the eyebolt 54 is rotated in a clockwise direction with respect to the body member, the jaw 26 moves along shaft 29 and toward the stationary jaw 25. Connection means 28 is comprised of a handle portion 32 and a cylindrical collar portion 33 rotatably retained in an undercut portion, shown at 64, of the body member 24.

The handle portion 32 is an extension having a terminal hole 34 to which a lead of the switch is connected. The collar portion 33 is slidably engaged with the main body member 24 (0.002 inch tolerance to maintain electrical contact) so that relative rotational movement can occur allowing the main body member to rotate freely while the handle remains stationary. The body member 24 is preferably comprised of two portions 66 and 68 which are connected together by connecting bolts 35. Portion 68 includes a threaded portion 37 with that threading being left-hand threaded so that items placed thereon must be rotated counter clockwise.

Figure 5:
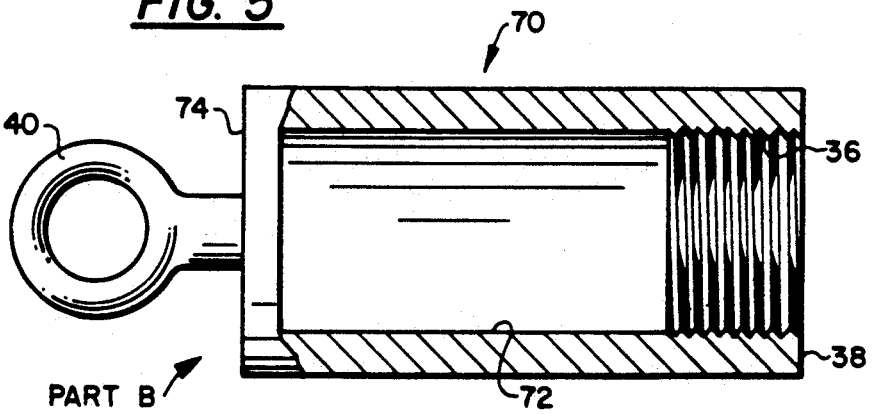
FIG. 5 is a side view of an embodiment of part B of the clamp which is adapted for eyebolt type connectors.

FIG. 5 is a side view of an embodiment of part B of the clamp. Part B is comprised of a body member, generally indicated at 70, which has complementary left-hand threads 30 formed on front portion of its hollow interim 72 which engage the left-hand threads 37 of part A. Accordingly, a clockwise rotation of part B with respect to part A will loosen threads 36 and 37. Counter clockwise rotation will tighten parts A and B together. Sufficient counter clockwise rotation of part B with respect to part A will cause end 38 of part B to lock against collar 39 of part A. A rotating device 40, here an eye, is also fixed to the rear wall 70 of part B to allow part B to be handled and/or rotated. It should be understood that the rear portion of part A, including eyebolt 54 and threads 37 will lie within the hollow interim 72 of part B when the latter is in position as shown in FIG. 8.

Figures 6, 7, 8:
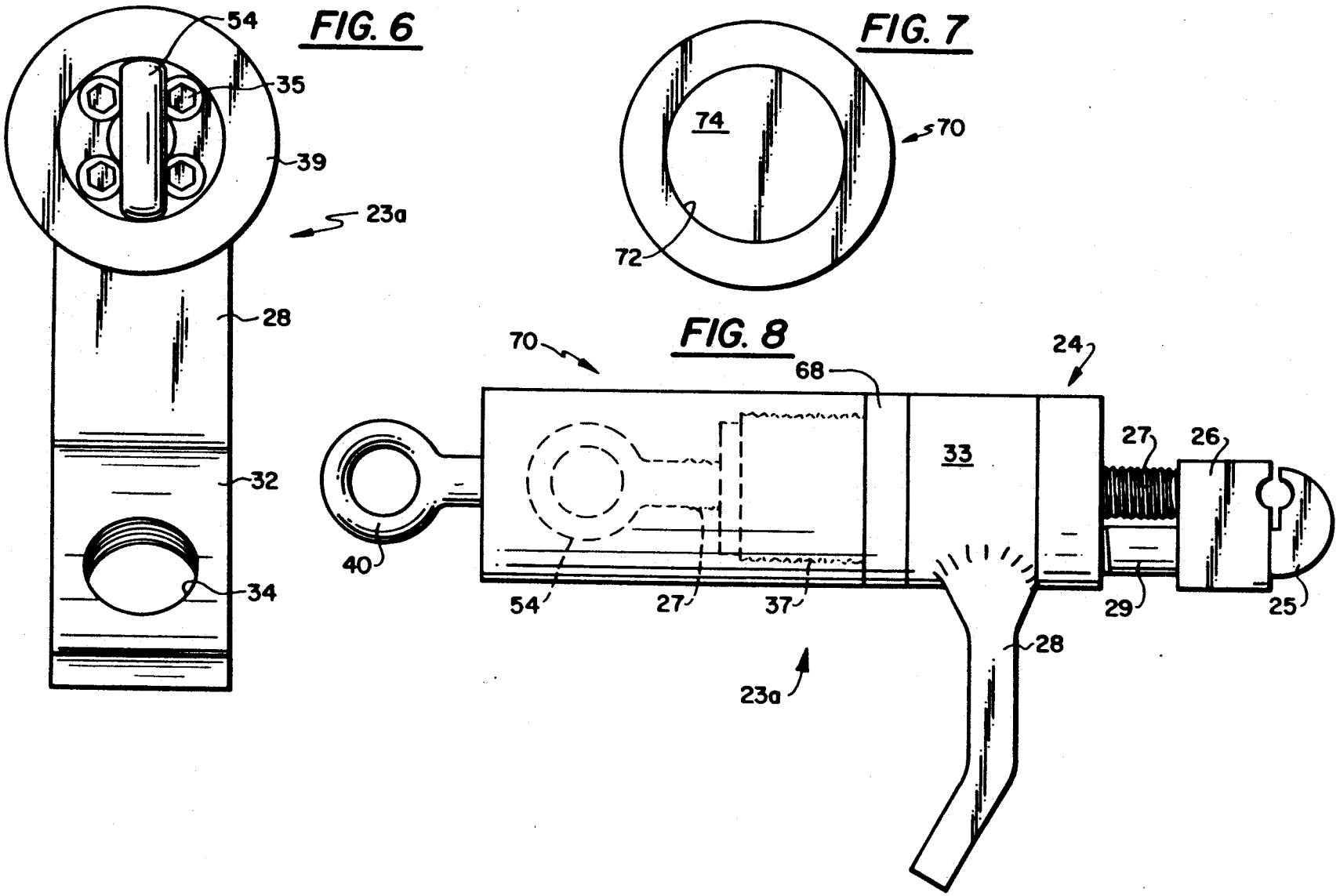
FIG. 6 shows a rear view of part A.
FIG. 7 shows a front view of part B.
FIG. 8 shows part A and part B assembled.

FIG. 6 is a rear view of part A of the assembly. Terminal hole 34 is provided in handle portion 32. Because a lead of the switch is connected to this terminal hole, a grip-all hot stick, as shown at 74 in FIG. 1, can be used to hold both part A of the terminal clamp and the switch lead, regardless of whether or not part B is attached to part A. Such hot sticks are well known insulated devices and it is not believed that further description thereof is required to provide a full and complete description of the present invention. Due to collar portion 33, the clamp body 24 can rotate relative to collar portion 33 about axis A when being held by the hot stick.

A hot stick is used to rotate both the means for moving the clamping means 27 of part A and also the rotating means 40 of part B. This hot stick does not form an electrical connection with the clamp, rather it serves to insulate the person using the clamp being manipulated from electrical shocks.

FIG. 7 is a front view of part B. FIG. 8 is a side view of parts A and B assembled. In this embodiment, both parts A and B are made entirely of a conductive metal. In normal use, assembly occurs after part A is clamped to the eye of the transformer terminal. After part B is threaded in a counter clockwise direction onto part A, and after end 38 of part B locks with collar 39 of part A, part B is rotated still further in a counter-clockwise direction. Due to right hand threading of the eyebolt of the transformer, the counter clockwise rotation of the locked assembly loosens and unscrews the eyebolt from the transformer with the eyebolt and nut. Once the eyebolt of the transformer is loosened, the cable which was secured to the transformer by the eyebolt can be removed from the transformer. The disconnected eyebolt, attached cable, and nut remain connected to the clamp assembly.

To reconnect the cable and to retighten its eyebolt to the transformer bushing, part B is separated from part A. The means for moving the clamping means 27 of part A is then rotated in a clockwise direction. Accordingly, the eyebolt of the disconnected cable can be rotated in a clockwise direction and clamped to the transformer bushing. Later, when part A is to be removed from the tightened eyebolt, a modified switch disconnect hook is inserted into the transformer eyebolt. This hook prevents the eye from rotating when the jaws of part A are being disengaged from the eye by counter clockwise rotation of the means for moving the clamping means 27.

An important feature of the clamp is that all rotation of the various parts of the clamp are performed about a single axis, axis A. This construction reduces the possibility that the sides of the clamp or the tools being used to work on the clamp will fall outside this axis and make unintended contact with other objects. The handle 32 on part A is angled in the direction of axis A so that the switch lead connected to the handle extends from the clamp with a component in the direction of axis A. The orientation of axis A of the clamp can be controlled by a hot stick connectable either to the eye rotating device of part A or to eyebolt 40 of part B.

While the invention has been described in connection with what is presently considered to be the most practical and preferred embodiment, it is to be understood that the invention is not limited to the disclosed embodiment but, on the contrary, is intended to cover various modifications and equivalent arrangements included within the spirit and scope of the appended claims. For example, part B need not screw onto part A in a counterclockwise direction. Rather, part B may be secured to part A in any way in which part B does not become disconnected from part A by counterclockwise rotation. Furthermore, although the clamping jaws described herein are adapted for clamping onto the eyes of eyebolt connectors, the scope of this invention covers outfitting part A with other clamping mechanisms which are adapted for gripping other styles of connectors and connecting bolts.

INITIAL OPERATING PROCEDURE

The two connecting leads with elbows are plugged into the two bushing extenders of the switch, the leads being kept free from employees and equipment. The switch is positioned in such a manner that the leads are free moving with hot sticks without being obstructed or tangled. The tank of the switch is then grounded to common neutral and the work area is barricaded. All portions of the metal housing around the energized primary bushing where the connection or disconnection will be made are covered with protective equipment to prevent accidental contact. With the fuse installed, before each operation, a Bell Set is used to confirm switch operation in both the open and the closed position. The contact position of the switch is verified through the viewing port and the gauge is checked for proper operating pressure. If the needle of the gauge is in the red zone, the $SF_6$ gas pressure is low. The switch should not be operated with low gas pressure. If gas pressure is normal, the switch is connected to the common neutral with a 2/0 ground lead. After this preoperational check and coverup, a power cable can be either energized or de-energized.

SUBSEQUENT PROCEDURE FOR DE-ENERGIZING A LIVEFRONT CABLE

The particular power cable to be de-energized is first identified and a load current reading is taken to confirm that 50 amps or less is going to be dropped. Before either lead of the switch is connected to the livefront of the transformer, the contacts inside the switch are placed in an open position and are verified to be open through the viewing port. Part B of the clamp is also removed from both switch connecting leads. Using a grip-all hot stick, one crew member holds the loadside lead of the switch in the clear. The second crew member then connects the source lead of the switch to the energized terminal eyebolt connector that is not to be removed. At this point, the second crew member moves the switch into the closed position. A voltage detector is used to verify that the load side lead of the switch is energized through the switch. If the load side lead is not energized, the switch should be moved to the open position, the source lead should be removed from the transformer connector, and the source lead discharged to ground. The fuse can then be replaced and continuity through the switch again verified.

If, on the other hand, the load side lead is energized through the switch, the first crew member should connect the load side lead to the energized eyebolt connector of the transformer that is to be removed. An ampere reading is then performed to verify that some current is flowing through the switch.

Using a hot stick, part B is installed onto part A of the switch's load side lead. This is performed by rotating part B in a counter clockwise direction. This counter clockwise rotation is continued to loosen the eyebolt terminal connector nut. Once the cable to be disconnected and de-energized has been removed from the primary bushing plate, the cable and the attached clamp are held in the clear with the hot stick. Accordingly, part A of the load side lead remains attached to the eyebolt of the disconnected cable. Because the switch is closed, current is flowing through the switch.

The switch is then placed in the open position and the de-energized state of the disconnected cable verified with a voltage detector.

To disconnect the source lead from the energized eyebolt at the transformer, the hook of a modified disconnect attachment is inserted into the terminal connector eye. This prevents loosening of the connector nut when part A of the source lead is being disconnected by rotation in a counter clockwise direction.

To separate parts A and B of the load side lead from each other, the first crew member inserts a hook on the modified disconnect attachment into the eyebolt of the disconnected cable. Part B is then removed by rotating it in a clockwise direction.

To unclamp part A of the load side lead from the disconnected cable, a third crew member holds the disconnected cable in the clear with a holding stick while the eyebolt of part A is rotated in a counter clockwise direction. As a result, part A is unclamped from the eyebolt of the disconnected cable and the load side lead is disconnected from the disconnected cable.

Both switch leads are discharged to ground. After covering up the energized parts, the de-energized cable can be tested and grounded.

SUBSEQUENT PROCEDURE FOR ENERGIZING A LIVEFRONT CABLE

After the above-described preoperational check and coverup, the particular power cable to be energized is identified. The total name plate KVA to be picked up is confirmed to ensure that it does not exceed limits. Verification that all grounds have been removed and that the switch contacts are open is performed.

Part B of the clamp is removed from both leads of the switch. One crew member connects part A of the load side lead to the cable to be energized. This load side lead and the cable to be energized are then held in the clear.

A second crew member connects the source lead to the energized eyebolt at the transformer. The switch handle is then moved to the closed position. A voltage detector is used to verify that load side lead and attached cable are energized.

If the load side lead and cable are determined not to be energized, the switch is opened, both leads are disconnected, and both leads are discharged to ground. The fuse can then be replaced and continuity verified. The cable to be energized can be checked for a grounded, faulted, or overload condition.

If, on the other hand, the load side lead and cable to be energized are found to have been energized, part A of the loadside lead is used to reconnect the eyebolt of the cable to the bushing plate of the transformer. Clockwise rotation of part A tightens the eyebolt of the cable to the bushing plate.

In order to remove part A of the load side lead after the cable is reconnected, the hook of the modified disconnect attachment is inserted into the eye to prevent loosening the connector nut when part A is removed. Once disconnected, the load side lead is maintained in the clear while the switch handle is moved into the open position. A voltage detector is used to verify that the lead is de-energized by the switch.

To remove the source lead from the other eyebolt at the transformer, the hook on the modified disconnect attachment is inserted into the connector eye. Part A of the source lead is unclamped from the connector eyebolt and the source lead held in the clear. Now, both switch leads are disconnected from the transformer. Both leads are then discharged to ground.

What is claimed is:

1. A terminal clamp comprising:

a first part, comprising a body with an axis, a clamping member, and a means for moving the clamping member, the clamping member engaging the jaw portion of the body when the means for moving the clamping member is rotated with respect to the body in a clockwise direction about the axis of the body; and a second part, which is separable from said first part, said first and second parts each having interacting threads which cause said first and second parts to be joined together when said second part is rotated with respect to said first part in a counter clockwise direction about the axis of the body.

2. The terminal clamp of claim 1 wherein the jaw portion of the body has a contacting surface which substantially perpendicularly intersects the axis of the body, the clamping member being movable relative to the body, at least a part of the clamping member being disposed between the means for moving and the contacting surface.

3. The terminal clamp of claim 1 wherein said first part further comprises a connection means for holding said first part, the connection means comprising:

a rotatable collar portion which slidably engages the body of said first part so that the body of said first part is freely rotatable about the axis when the collar portion is fixed; and a handle portion which extends from the collar portion so that the handle portion and the clamping member are electrically connected.

4. The terminal clamp of claim 3 wherein means defining a hole is included in the handle portion of the connection means.

5. The terminal clamp of claim 1 wherein the body comprises a clamp end portion and a manipulating end portion, the axis of the body intersecting the clamp end portion and the manipulating end portion, the jaw portion being a part of the clamp end portion, the means for moving the clamping member comprising:

a threaded shaft which is oriented along said axis to interact with a threaded bore of said body; and an exposed portion connected to said threaded shaft and extending from the manipulating end portion of the body.

6. The terminal clamp of claim 5 wherein the exposed portion of the means for moving comprises a circular ring of metal.

7. The terminal clamp of claim 5 wherein said second part comprises:

a rotating means for grasping and rotating said second part; and a tubular body portion having a closed end and an open end, the rotating means being disposed on said closed end, the interacting threads of said second part being located on an inside wall of the tubular body portion so that the tubular body portion fits over the exposed portion of the means for moving of said first part when the interacting threads of said first part and said second part are engaged.

8. The terminal clamp of claim 7 wherein the exposed portion of the means for moving comprises a circular ring of metal, and wherein the rotating means of said second part comprises a ring of metal.

9. The terminal clamp of claim 3, wherein the handle portion has an angled portion which is angled away from said jaw portion so as to extend in a direction which has a component in the direction of the axis of the body of the first part.

10. A loadmake/loadbreak switch assembly comprising:

first and second terminal clamps, each of the terminal clamps comprising:

a said first part, comprising clamping jaws and a means for operating the clamping jaws, the clamping jaws being closed when the means for operating the clamping jaws is rotated in a first direction with respect to the clamping jaws; and a said second part, which includes a securing means for securing said second part to said first part such that when said second part is secured to said first part a rotation of said second part in a direction opposite to said first direction leaves the means for operating the clamping jaw stationary with respect to the clamping jaws;

first and second electrically conducting leads;

a high amperage switch;

an operating handle for opening and closing the high amperage switch;

a fuse; and wherein the said first part of the first terminal clamp, the first lead, the said first part of the second terminal clamp, the second lead, the high amperage switch and the fuse are connected in series such that an electrical connection is established from the said first part of the first terminal clamp, through the first lead, through the high amperage switch, through the fuse, through the second lead, and to the said first part of the second terminal clamp when the operating handle is positioned to close the high amperage switch.

11. The load make/load break switch assembly of claim 10, wherein said first part and said second part each have interacting threads which cause said first part and said second part to be joined together when said second part is rotated with respect to the clamping jaws of said first part in a direction opposite to said first direction, the securing means of said second part being the interacting threads of said second part.

12. The loadmake/loadbreak switch assembly of claim 10, wherein said first part further comprises a connection means for holding said first part, the connection means comprising:

a rotatable collar portion which slidably engages said first part so that the clamping member is freely rotatable with respect to the collar portion; and a handle portion which extends from the collar portion so that the handle portion and the clamping member are electrically connected, the handle portion of the first terminal clamp being connected to the first lead, the handle portion of the second terminal clamp being connected to the second lead.

13. A method of using a terminal clamp to disconnect an eyebolt from a bushing plate, the eyebolt having an eye and being loosened from the bushing plate by counterclockwise rotation relative to the bushing plate, the terminal clamp comprising:

a first part, comprising clamping jaws and a means for operating the clamping jaws, the clamping jaws being closed when the means for operating the clamping jaws is rotated in a first direction with respect to the clamping jaws; and a second part, which includes a securing means for securing said second part to said first part such that when said second part is secured to said first part a rotation of said second part in a direction opposite to said first direction leaves the means for operating the clamping jaws stationary with respect to the clamping jaws, the method comprising the steps of:

(a) rotating the means for operating the clamping jaws in said first direction relative to the clamping jaws so that the clamping jaws of said first part are clamped the onto the eye of the eyebolt;

(b) securing said second part onto said first part; and (c) rotating said second part in said opposite direction so that the clamping jaws of said first part rotate the eyebolt in said opposite direction.

14. The method of claim 13 wherein said first part of the terminal clamp further comprises:

a connection means for holding said first part, the connection means comprising:

a rotatable collar portion which slidably engages said first part so that the clamping jaws are freely rotatable with respect to the collar portion; and a handle portion which extends from the collar portion so that the handle portion and the clamping jaws are electrically connected, the method further comprising the step of:

(d) using the handle portion of said first part to establish electrical continuity with the eyebolt via the rotatable collar portion and the clamping jaws.

15. The method of claim 14 further comprising the steps of:

(e) removing said second part from said first part; and (f) rotating the means for operating the clamping jaws in said opposite direction relative to the clamping means so that the clamping jaws of said first part releases the eyebolt.

16. The method of claim 15 further comprising the step of:

(g) before step (f), inserting a rigid object into the eye of the eyebolt.

17. The method of claim 13 wherein the eyebolt comprises a shaft which extends through a hole in an end of a power cable, the shaft being engaged by a nut so that the power cable is connected to the eyebolt by the nut, the method thereby disconnecting the end of the power cable from the bushing plate during step (c), the power cable remaining attached to said first part via the eyebolt which is clamped by the clamping jaws.

* * * * *